US008313842B2

(12) United States Patent
Kinoshita et al.

(10) Patent No.: US 8,313,842 B2
(45) Date of Patent: Nov. 20, 2012

(54) TI-BASED CERMET

(75) Inventors: Hideyoshi Kinoshita, Satsumasendai (JP); Takashi Tokunaga, Satsumasendai (JP)

(73) Assignee: Kyocera Corporation, Kyoto (JP)

( * ) Notice: Subject to any disclaimer, the term of this patent is extended or adjusted under 35 U.S.C. 154(b) by 403 days.

(21) Appl. No.: 12/527,815

(22) PCT Filed: Feb. 25, 2008

(86) PCT No.: PCT/JP2008/054000

§ 371 (c)(1),
(2), (4) Date: Aug. 19, 2009

(87) PCT Pub. No.: WO2008/108418

PCT Pub. Date: Sep. 12, 2008

(65) Prior Publication Data

US 2010/0089203 A1 Apr. 15, 2010

(30) Foreign Application Priority Data

Feb. 26, 2007 (JP) ..... 2007-045609
Mar. 27, 2007 (JP) ..... 2007-082450

(51) Int. Cl.
*B32B 9/00* (2006.01)

(52) U.S. Cl. ..... 428/472; 428/469; 428/697; 428/698

(58) Field of Classification Search ..... 428/469, 428/472, 697, 698, 699
See application file for complete search history.

(56) References Cited

U.S. PATENT DOCUMENTS

| | | | | |
|---|---|---|---|---|
| 4,574,011 | A | 3/1986 | Bonjour et al. | |
| 5,802,955 | A | 9/1998 | Stoll et al. | 92/248 |
| 7,244,519 | B2 | 7/2007 | Festeau et al. | 428/698 |
| 7,521,131 | B2 * | 4/2009 | Yamamoto | 428/698 |
| 7,811,683 | B2 * | 10/2010 | Zhu et al. | 428/697 |
| 2006/0051618 | A1 | 3/2006 | Festeau et al. | 428/698 |
| 2006/0068225 | A1 | 3/2006 | Yamamoto | |

FOREIGN PATENT DOCUMENTS

| | | | |
|---|---|---|---|
| GB | 622041 | * | 4/1949 |
| GB | 1309634 | * | 3/1970 |
| JP | 61261453 | A | 11/1986 |
| JP | 11-502260 | | 2/1999 |
| JP | 2003-200307 | | 7/2003 |
| JP | 2004-249380 | | 9/2004 |
| JP | 2006123159 | A | 5/2006 |
| JP | 2006346776 | A | 12/2006 |
| WO | 96/27687 | | 9/1996 |

OTHER PUBLICATIONS

European office action for corresponding European application 08721420.1.

Japanese language office action dated Dec. 16, 2011 and its English language translation for corresponding Japanese application 2009534788.

* cited by examiner

*Primary Examiner* — Archene Turner
(74) *Attorney, Agent, or Firm* — DLA Piper LLP (US)

(57) ABSTRACT

A Ti-based cermet 1 includes at least one of Co and Ni, at least one of titanium carbide, titanium nitride and titanium carbonitride including at least one selected from the metal elements of groups 4, 5 and 6 of the periodic table, and Ru.

7 Claims, 5 Drawing Sheets

TI-BASED CERMET

CROSS REFERENCE TO RELATED APPLICATION

This application is a national stage of International Application No. PCT/JP2008/054000 filed on Feb. 25, 2008, which also claims the benefit of priority under 35 USC 119 to Japanese Patent Application No. 2007-045609 filed on Feb. 26, 2007 and Japanese Patent Application No. 2007-082450 filed on Mar. 27, 2007, the entire contents of which are incorporated herein by reference.

TECHNICAL FIELD

The present invention relates to a Ti-based cermet, particularly to a Ti-based cermet that is preferably used for cutting tools that have cutting edges of increased thermal impact resistance.

BACKGROUND ART

At present, cemented carbide containing WC as a main component or sintered alloys such as Ti-based cermet containing Ti as a main component are widely used to form members that require wear resistance, sliding property and chipping resistance, such as cutting tool, wear resisting member and sliding member. For the sintered alloys, development efforts have been made for new compositions that would improve the performance.

For example, Patent Document 1 discloses that the hardness, strength and fracture toughness can be improved, thereby to improve wear resistance and chipping resistance of cutting tools, by forming Ti-based cermet that has Ti-based main phase and dispersion phase such as oxide or boride of Mg, Al, Zr, Hf, Y and lanthanoid rare earth elements.

Patent Document 2 discloses that the corrosion resistance can be improved, in comparison with the conventional sintered carbide alloys, while maintaining the mechanical properties thereof, by forming a plunger used in a hyper compressor from cermet that has corrosion resistance and wear resistance and contains a ceramic component and a binder that contains an iron group metal as a main component while forming solid solution of Ru, Rh, Pd, Os, Ir, Pt or Au. This document describes an example of cermet wherein cemented carbide that is based on composition of WC—Co, and contains Ru or the like as well as Co added as the binder phase component in the cemented carbide alloy, and describes that corrosion resistance of the cemented carbide alloy is improved.

Patent Document 1: Japanese Unexamined Patent Publication No. 2003-200307

Patent Document 2: National Publication of Translated Version No. 11-502260

DISCLOSURE OF THE INVENTION

Problems to be Solved by the Invention

However, the cermet containing the particular dispersion phase of Patent Document No. 1 has insufficient thermal impact resistance, which leads to such a problem that vicinity of the cutting edge is prone to thermal cracks that eventually cause chipping of the cermet. It is also hard to improve the thermal impact resistance even by providing the cemented carbide with Ru added thereto, as described in Patent Document No. 1.

The cutting tool of the present invention has an object of improving the thermal impact resistance of the Ti-based cermet that has been characterized by low thermal impact resistance.

Means for Solving the Problems

According to an aspect of the present invention, a Ti-based cermet contains at least one of Co and Ni, at least one composite of carbide, nitride and carbonitride at least one selected from the metal elements of groups 4, 5 and 6 of the periodic table with Ti contained as a main component, and Ru.

Effect of the Invention

According to the present invention, the Ti-based cermet improves thermal impact resistance.

PREFERRED EMBODIMENTS FOR CARRYING OUT THE INVENTION

Figure 2:
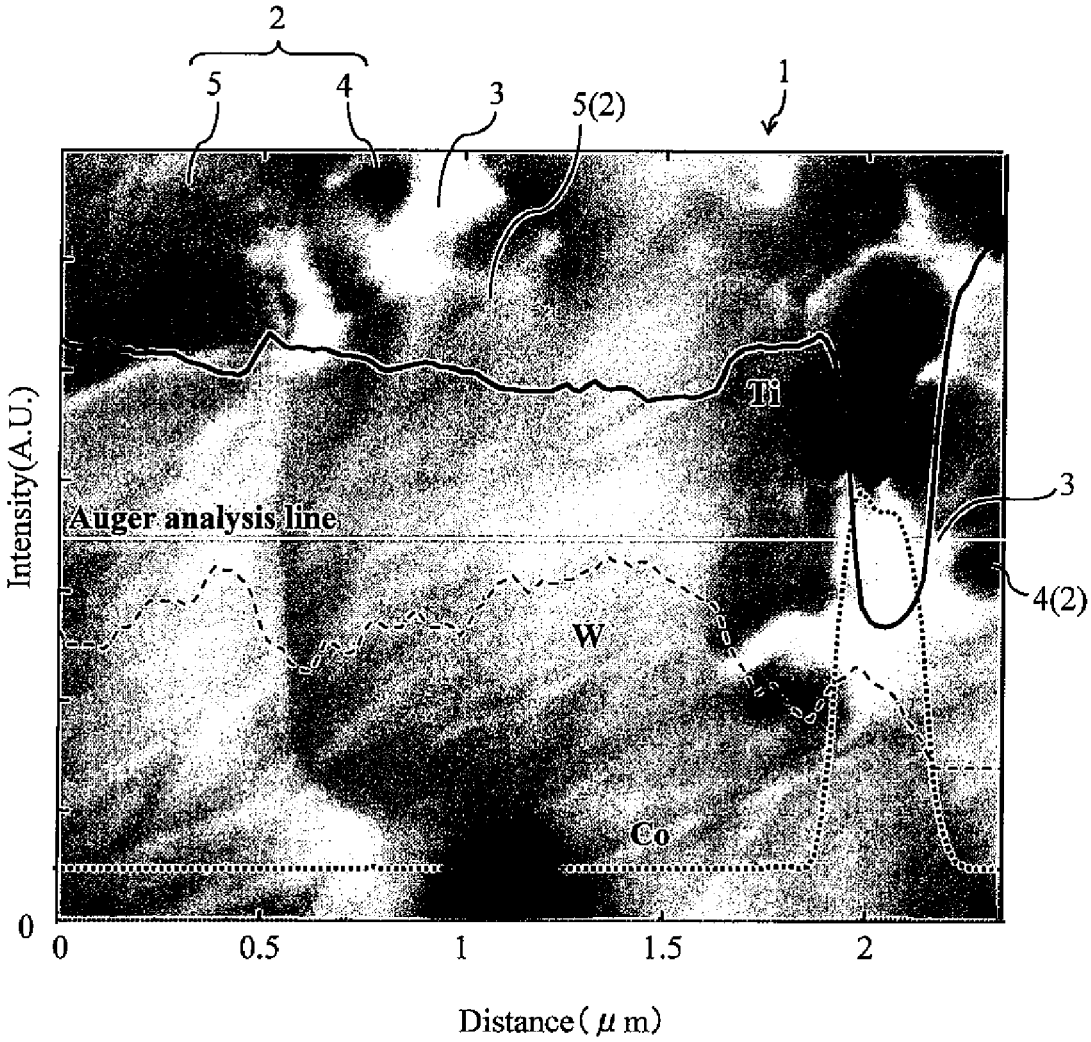
FIG. 2 shows the result of Auger analysis of a particular portion of cermet containing second hard phase and binder phase in cermet of the conventional art.
Figure 3:
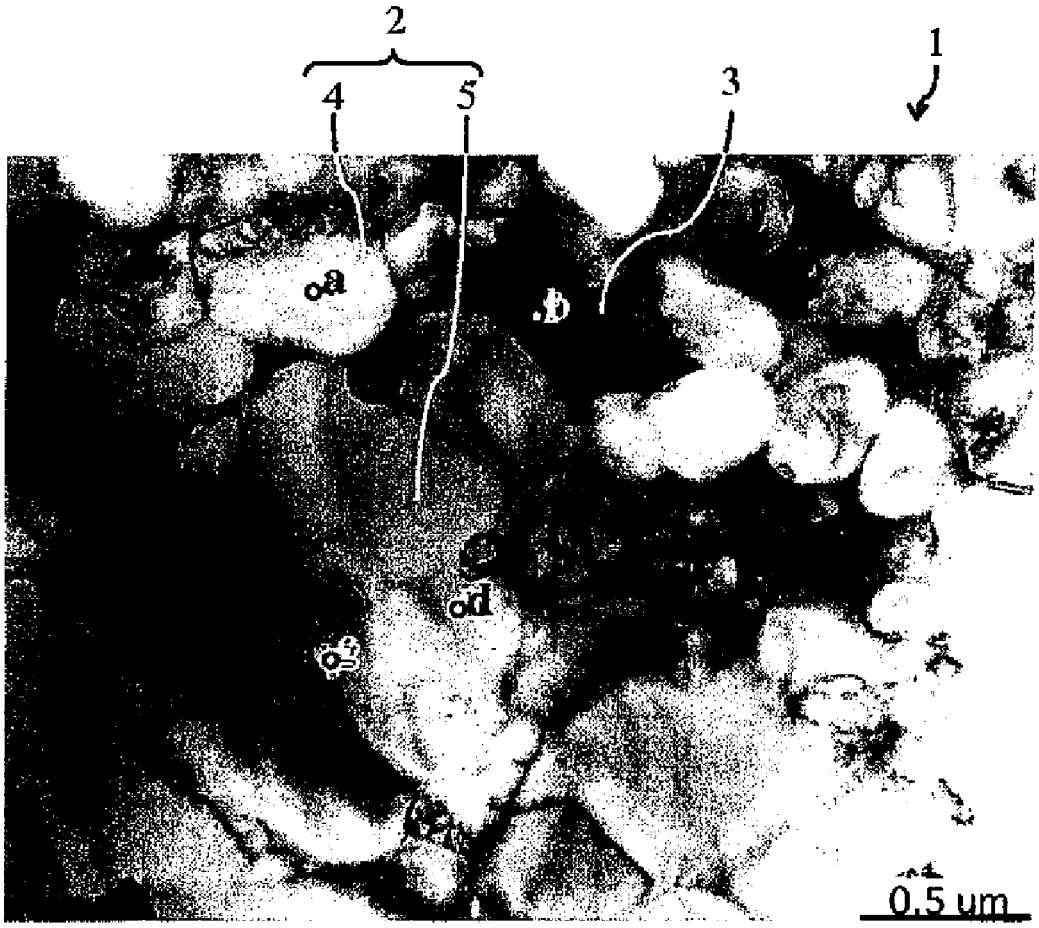
FIG. 3 is a transmission electron microscope (TEM) photograph of particular portions in an example of cermet of the present invention.
Figure 4A:
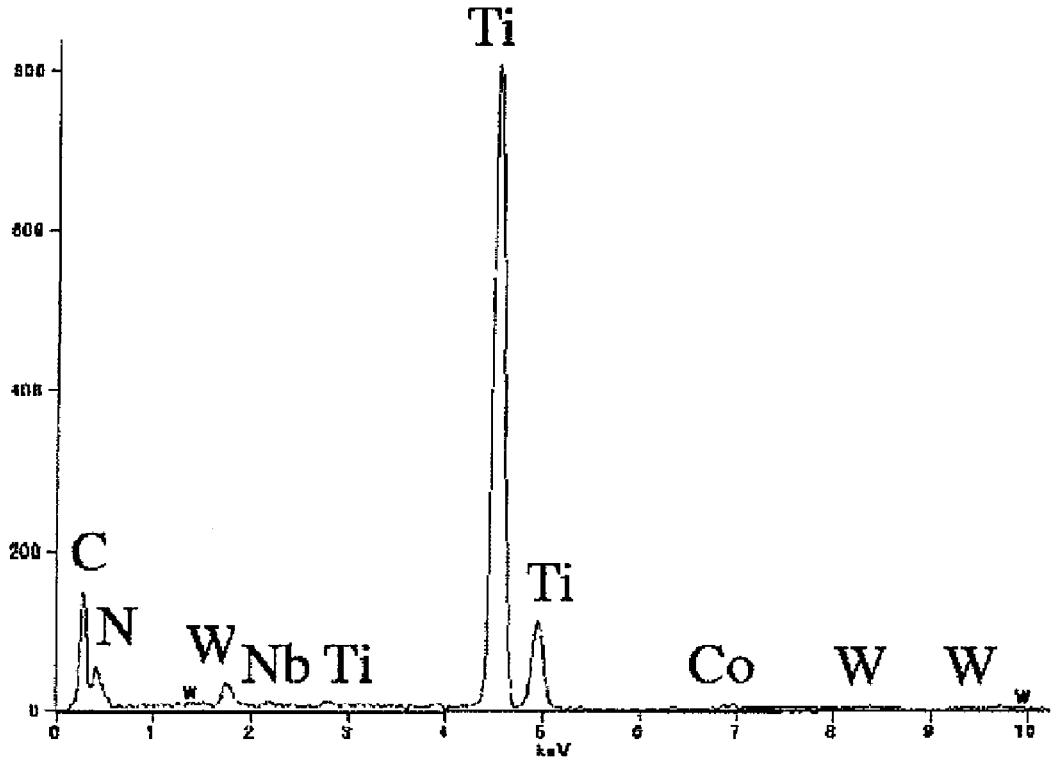
FIG. 4 shows the result of energy dispersion spectroscopy (EDS) analysis applied to (a) point a, (b) point b, (c) point c and (d) point d.
Figure 4B:
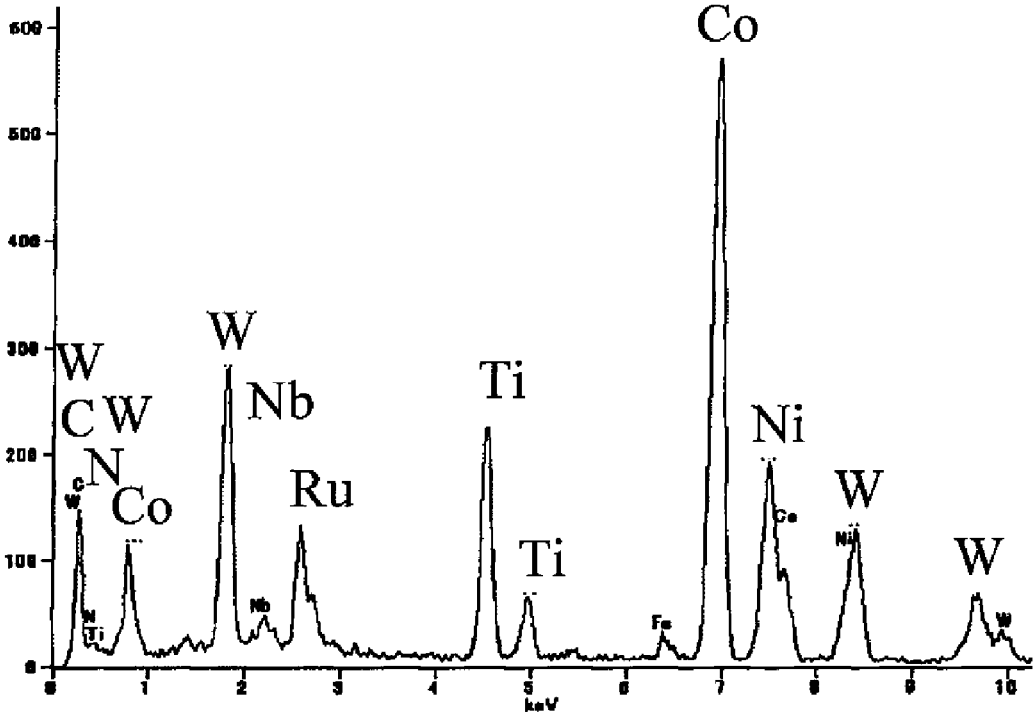
Figure 4C:
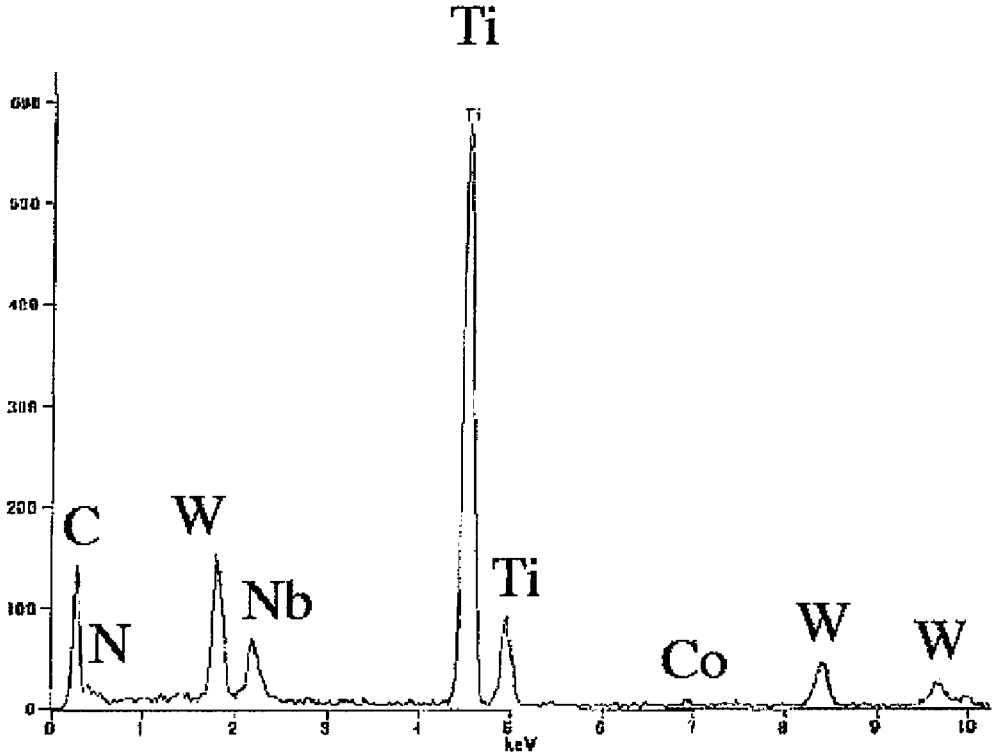
Figure 4D:
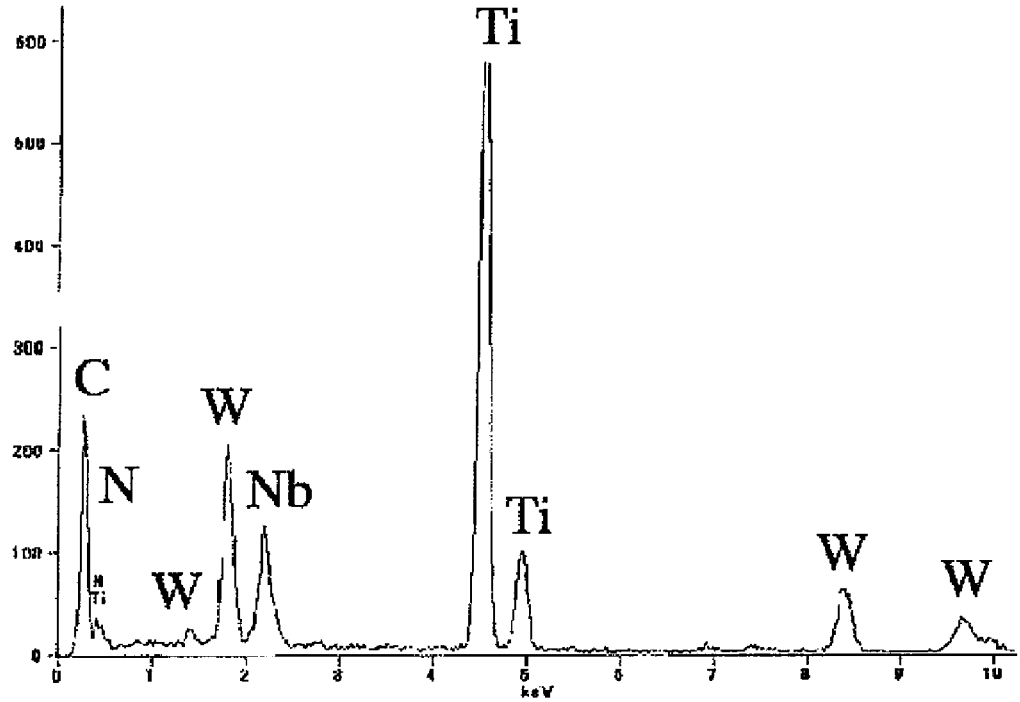

A Ti-based cermet (hereinafter referred to simply as cermet) 1, according to an embodiment of the present invention, will be described with reference to FIG. 1 which shows the proportions of the elements determined by the Auger analysis of a particular portion of the cermet containing a second hard phase 5 in an example of the cermet 1 of the present invention, FIG. 2 which shows the proportions of the elements determined by the Auger analysis of a particular portion of the cermet containing second hard phase of the conventional art, FIG. 3 which is a transmission electron microscope (TEM) photograph of a section of the cermet 1, and FIGS. 4(*a*) to (*d*) which show the result of energy dispersion spectroscopy (EDS) analysis applied to the each points, a, b, c, d, indicated in FIG. 3.

The cermet 1 contains at least one of Co and Ni, at least one of carbide, nitride and carbonitride of at least one kind selected from among the metal elements of groups 4, 5 and 6 of the periodic table with Ti contained as a main component, and Ru. This constitution results in high thermal impact resistance of the cermet 1.

The concentration of Ru is preferably in a range from 0.1 to 10.0% by mass because it enables the cermet 1 to maintain high hardness.

Now, the cermet 1 has such a constitution as comprising the hard phase 2, constituted from nitride or carbonitride of the metal elements of groups 4, 5 and 6 of the periodic table with Ti contained as a main component, is bound by a binder phase 3 constituted mainly from Co or Ni, while the hard phase 2 comprises a first hard phase 4 constituted mainly from TiCN and a second hard phase 5 constituted from composite solid solution of carbonitride of at least one kind selected from among the metal elements of groups 4, 5 and 6 of the periodic table and Ti. And the second hard phase 5 comprising W as an component as shown in FIG. 1.

Figure 1:
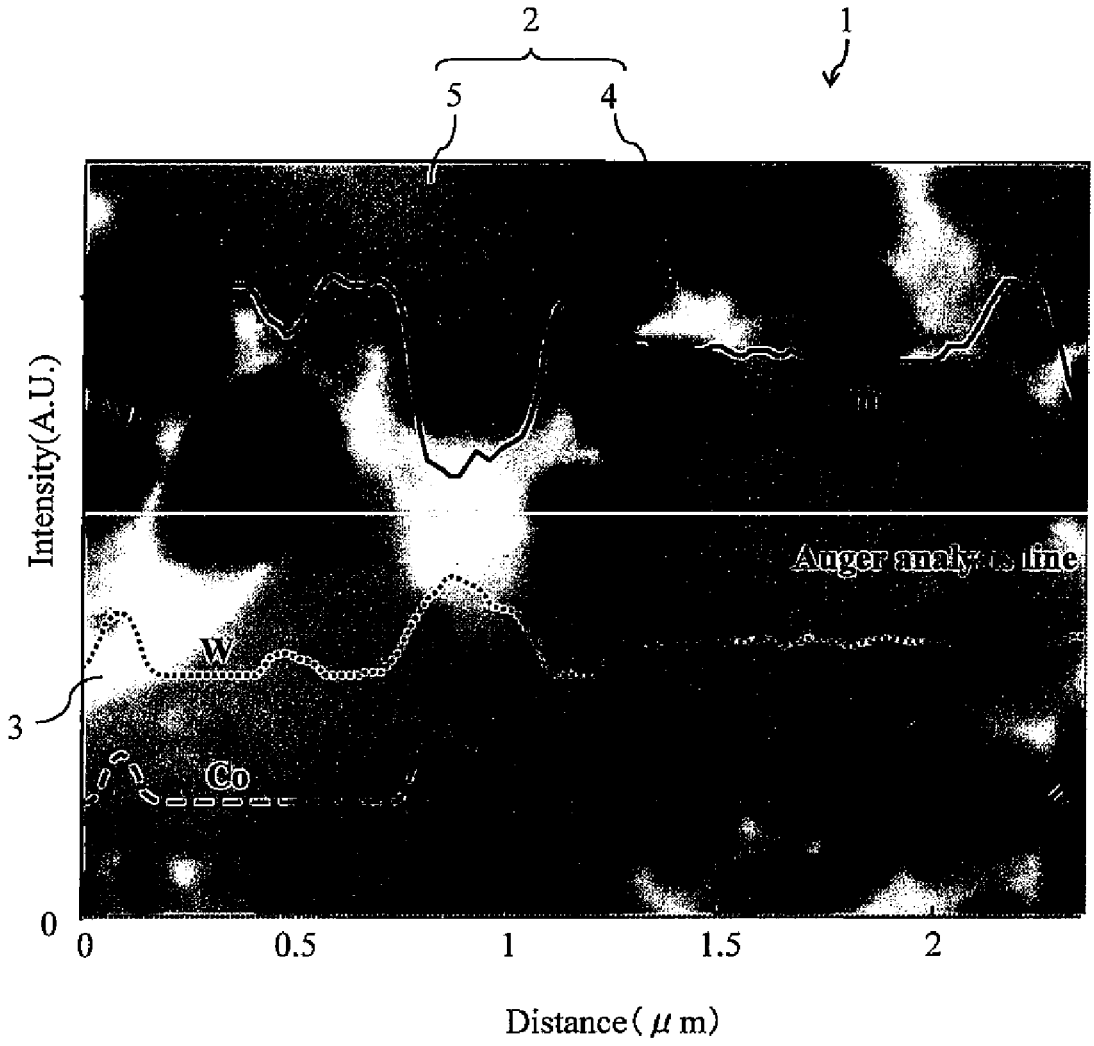
FIG. 1 shows the result of Auger analysis of a particular portion of cermet containing second hard phase and binder phase in an example of cermet of the present invention.

When the microstructure in a section is observed under a scanning electron microscope, the first hard phase 4 is recognized as black grains as shown in FIG. 1. On the other hand, the second hard phase 5 is recognized as whitish gray grains, or grains having core-shell structure which has a white core and a whitish gray shell surrounding the white core. The color referred to as whitish gray above may appear more of white or gray depending on the conditions of taking the photograph. While the first hard phase 4 is constituted from black grains formed from TiCN, it may also contain Co and/or Ni. The first hard phase 4 may have a cored structure having a whitish gray shell located on the outside. On the other hand, the binder phase 3 is recognized as a white region.

As clearly indicated by the proportions of element concentrations determined by Auger analysis shown in FIG. 1, the cermet 1 contains W but has such a constitution as the amount of W that forms solid solution in the binder phase 3 is larger than the amount of W that forms solid solution in the second hard phase 5. That is, the cermet 1 has more W component forming solid solution in the binder phase 3 than in the case of the Ti-based cermet of the conventional art shown in FIG. 2. As a result, heat conductivity and high-temperature strength of the binder phase 3 are supposedly improved, thus resulting in the cermet 1 having further improved thermal impact resistance. Meanwhile Ru forms solid solution mainly in the binder phase 3. In order to form such a structure, it is necessary to add Ru to the stock material and sinter the material under predetermined conditions when manufacturing the cermet 1.

FIG. 4(*a*) shows the composition of the first hard phase 4 that contains Ti, C and N as main components. FIG. 4(*b*) shows the composition of the binder phase 3 that contains Co as main component and much contents of Ni and W by compared with the first hard phase 4 and the second hard phase 5 (See FIG. 4(*a*), 4(*c*), 4(*d*)). FIG. 4(*c*) shows the composition of the first hard phase 4 that exists in the second hard phase 5 and contains Ti, C and N as main components. FIG. 4(*d*) shows the composition of the second hard phase 5 that contains Ti, C and N as main components and the second hard phase 5 comprise W, Nb. The amount of W that forms solid solution in the binder phase 3 is larger than the amount of W that forms solid solution in the second hard phase 5, and the amount of Nb that forms solid solution in the second hard phase 5 is larger than the amount of Nb that forms solid solution in the binder phase 3.

This constitution makes it possible to further improve the heat conductivity and high-temperature strength of the binder phase 3 and improve the oxidization resistance of the second hard phase 5, thereby making it possible to further improve the heat conductivity and high-temperature strength of the binder phase of the cermet 1. As a result, it is made possible to further increase the hardness and thermal impact resistance of the cermet 1 at high temperatures. In order to form such a structure, it is necessary to add Ru to the stock material and sinter the material under predetermined conditions, which will be described later, when manufacturing the cermet 1.

In order to improve the heat conductivity and thermal impact resistance of the cermet 1, it is preferable to control the proportion of W content to the total amount of the metal elements of groups 4, 5 and 6 of the periodic table contained in the second hard phase 5 in a range from 10 to 20% by mass and control the proportion of W content to the total amount of the metal elements of groups 4, 5 and 6 of the periodic table and the iron group metal elements contained in the binder phase 3 in a range from 30 to 70% by mass.

It is also preferable that the mean grain size of the second hard phase 5 is larger than the mean grain size of the first hard phase 4 when a sectional structure inside of the cermet is observed. Specifically, ratio ($b_i/a_i$) of the mean grain size $a_i$ of the first hard phase 4 located inside and the mean grain size $b_i$ of the second hard phase 5 is preferably in a range from 2 to 8, in which case the second hard phase 5 contributes effectively to the propagation of heat so as to improve the heat conductivity and thermal impact resistance of the cermet 1. For the purpose of keeping the cermet 1 to be resistant to breaking, preferable range of the ratio ($b_i/a_i$) is from 3 to 7.

Grain size of the hard phase 2 in the present invention is measured according to the method of measuring the mean grain size of cemented carbide specified in CIS-019D-2005. In case the hard phase 2 has cored structure, a grain containing the core and the surrounding shell is regarded as one cell of the hard phase and the grain size thereof is measured.

It is also preferable that the mean area of the second hard phase 5 is larger than the mean area of the first hard phase 4 in a section inside of the cermet 1. Specifically, ratio ($B_i/A_i$) of the mean area $A_i$ of the first hard phase 4 and the mean area $B_i$ of the second hard phase 5 is preferably in a range from 1.5 to 5, in which case the second hard phase 5 contributes effectively to the propagation of heat so as to improve the thermal impact resistance of the cermet 1.

It is also preferable that there is a surface region where ratio ($B_s/A_s$) of the mean area $A_s$ of the first hard phase 4 to the whole hard phase 2 and the mean area $B_s$ of the second hard phase 5 to the whole hard phase 2 is greater than the ratio ($B_i/A_i$) in the surface of the cermet 1 when the structure of a section in the vicinity of the surface of the cermet 1 is observed, in which case the heat conductivity is improved in the vicinity of the surface of the cermet 1 and thermal impact resistance of the cermet 1 can be improved. Particularly preferable range of the ratio ($B_s/A_s$) is from 3 to 10 and preferable range of ratio of the ratio ($B_s/A_s$) to the ratio ($B_i/A_i$) is from 1.2 to 2.3.

In the surface region, it is preferable that ratio ($b_s/b_i$) of the mean grain size $b_s$ of the second hard phase 5 in the surface region and the mean grain size $b_i$ of the second hard phase 5 located inside is preferably in a range from 1.1 to 2, in which case the second hard phase 5 in the surface region 8 contributes effectively to the propagation of heat so as to improve the heat conductivity and thermal impact resistance of the cermet 1. Thickness of the surface region is preferably in a range from 30 to 300 μm in order to improve the heat conductivity in the surface region of the cermet 1 and improve the thermal impact resistance of the cermet 1. To observe the sectional structure of the inside of the cermet 1 of the present invention, a region whose depth is 1,000 μm or deeper from the surface of the cermet 1 is observed.

It is also preferable that total proportion of nitride or carbonitride of the metal elements of groups 4, 5 and 6 of the periodic table with Ti contained as a main component constituting the hard phase in the cermet 1 is in a range from 70 to 96% by mass, more preferably from 85 to 96% by mass in order to improve the wear resistance. On the other hand, well balanced hardness and toughness of the substrate can be achieved by controlling the proportion of the binder phase 3 in a range from 4 to 15% by mass. The binder phase preferably contains Co in concentration of 65% by mass or more to the total amount of iron group metal in order to improve the thermal impact resistance of the cutting tool. In order to ensure satisfactory sintering of the cermet 1 so as to obtain the sintered surface of the cermet 1 to be smooth surface, it is preferable that Ni is contained in the concentration of 5 to 50% by mass, particularly from 10 to 35% by mass of the total amount to iron group metal.

(Manufacturing Method)

An example of manufacturing method for the cermet is now described.

A TiCN powder having a mean particle size of 0.1 to 1.2 μm, a metal Ru powder having a mean particle size of 5 to 50 μm, one selected from among a carbide powder, a nitride powder and a carbonitride powder of the other metals described above, a Co powder and a Ni powder are mixed.

A binder is added to the mixed powder, which is then formed into a green compact having a predetermined shape by a known forming method such as press molding, extrusion molding, injection molding or the like.

According to the present embodiment, the green compact is sintered under the following conditions so as to make the cermet having the predetermined structure described above. Sintering is carried out through processes of, for example, (a) raising the temperature at a rate of 5 to 15° C. per minute up to a sintering temperature A in a range from 1,050 to 1,250° C., then raising the temperature from the sintering temperature A at a rate of 0.1 to 3° C. per minute up to a sintering temperature B in a range from 1,275 to 1,375° C., (b) raising the temperature from the sintering temperature B at a rate of 4 to 15° C. per minute up to a sintering temperature C in a range from 1,450 to 1, 630° C. in an atmosphere with partial pressure of nitrogen in a range from 30 to 2,000 Pa, (c) sintering at the sintering temperature C in a nitrogen gas atmosphere for 0.5 to 3 hours, and (d) cooling down in an inert gas atmosphere such as nitrogen (N), argon (Ar) or helium (He).

The Ti-based cermet 1 made under the manufacturing conditions described above has such a constitution as the amount of W that forms solid solution in the binder phase 3 is larger than the amount of W that forms solid solution in the hard phase 2.

A coating layer is formed on the surface of the cermet 1 as required. The coating layer may be preferably formed by a physical vapor deposition (PVD) such as ion plating process or sputtering process.

As a composition of a coating layer, it is preferable in view of high wear resistance and high chipping resistance that a coating layer is comprised of $Ti_{1-a-b-c-d}Al_aW_bSi_cM_d$ ($C_xN_{1-x}$), wherein M is at least one selected from Nb, Mo, Ta, Hf and Y, $0.45 \leqq a \leqq 0.55$, $0.01 \leqq b \leqq 0.1$, $0.01 \leqq c \leqq 0.05$, $0.01 \leqq d \leqq 0.1$, $0 \leqq x \leqq 1$.

EXAMPLES

The present invention is now described in detail by way of examples.

Example 1

A TiCN powder having a mean particle size ($d_{50}$ value) of 0.6 μm as measured by micro track method, a WC powder having a mean particle size of 1.1 μm, a TiN powder having a mean particle size of 1.5 μm, a TaC powder having a mean particle size of 2 μm, a NbC powder having a mean particle size of 1.5 μm, a MoC powder having a mean particle size of 1.5 μm, a ZrC powder having a mean particle size of 1.8 μm, a VC powder having a mean particle size of 1.0 μm, a Ni powder having a mean particle size of 2.4 μm, a Co powder having a mean particle size of 1.9 μm, a metal Ru powder having a mean particle size of 40 μm, and a $Y_2O_3$ powder having a mean particle size of 0.5 μm were mixed in proportions shown in Table 1. The mixture was mixed with isopropyl alcohol (IPA) in a wet mixing process by means of a ball mill made of stainless steel and cemented carbide balls, and was mixed with 3% by mass of paraffin added thereto. Then the mixed material was pressed with a pressure of 200 MPa to form a green compact having the shape of a throwaway tip tool of CNMG120408. The green compact was heated at a rate of 10° C. per minute to 1,200° C., then the temperature was raised at a rate of 0.5° C. per minute from 1,200° C. to 1,350° C., and the temperature was further raised at a rate of 5° C. per minute to 1,375° C., followed by sintering in nitrogen atmosphere of 800 Pa at such a sintering temperature for the period of holding the sintering temperature that are shown in Table 1, thereby to obtain samples Nos. 1 to 9 of the throwaway tips made of cermet.

TABLE 1

| Sample | Material composition (% by mass) | | | | | | | | | | | Sintering conditions | |
|---|---|---|---|---|---|---|---|---|---|---|---|---|---|
| | | | | | | | | | | | | Temperature | Time |
| No. | TiCN | WC | TiN | TaC | MoC | NbC | ZrC | VC | Ni | Co | Ru | (° C.) | (hr) |
| 1 | 49 | 17 | 10 | 2 | 0 | 12 | 3 | 1 | 2 | 3 | 1 | 1575 | 1 |
| 2 | 60 | 10 | 5 | 0 | 0 | 10 | 3 | 1 | 2 | 6 | 3 | 1550 | 1 |
| 3 | 39 | 15 | 13 | 5 | 1 | 10 | 3 | 1 | 3 | 5 | 5 | 1550 | 0.5 |
| 4 | 46 | 14 | 13 | 2 | 1 | 6 | 1 | 2 | 1 | 6 | 8 | 1525 | 1.5 |
| 5 | 60 | 18 | 3 | 1 | 1 | 3 | 1 | 1 | 3 | 6 | 3 | 1550 | 1 |
| 6 | 54.5 | 15 | 11 | 0 | 0 | 9 | 1 | 2 | 2 | 5 | 0.5 | 1575 | 0.5 |
| 7 | 49 | 20 | 10 | 1 | 0 | 1 | 1 | 1 | 2 | 4 | 11 | 1550 | 1.5 |
| *8 | 51 | 10 | 18 | 5 | 0 | 0 | 2 | 2 | 4 | 8 | — | 1550 | 1 |
| *9 | 49 | 5 | 16 | 3 | 1 | 12 | 3 | 0 | 4 | 6 | $Y_2O_3$ 1 | 1550 | 1 |

The samples marked "*" are out of the scope of the present invention.

The cermet thus obtained was observed under a scanning electron microscope (SEM) and was photographed with 10,000 times magnification. Image analysis was applied to a region of 8 μm by 8 μm by using image analysis software available in the market, for arbitrarily selected five points each on the surface and inside, to determine the presence of a hard phase, check the structure of the surface region and measure the mean grain sizes of the phases, and the proportions of the values were calculated. The results are shown in Table 2 and Table 3.

Quantitative analysis was conducted to determine the composition in the core and the surrounding shell of the second hard phase located in the cermet by the line analysis of Auger electron spectroscopy (AES). Auger electron spectroscopy (AES) was carried out under conditions of acceleration voltage of 20 keV, current of 10 nA flowing in the sample, and sample tilting angle of 30 degrees. Distribution of W concentration and proportion of the W content to the total amount of the metal elements of groups 4, 5 and 6 of the periodic table were calculated. Proportion was calculated by taking the mean grain size of five grains of the second hard phase 5 that were arbitrarily selected. The results are shown in Table 2.

The cutting tools made of the cermet were then subjected to cutting tests (wear resistance evaluation test and chipping resistance evaluation test) under the following cutting conditions. The results are shown in Table 3.

(Wear Resistance Evaluation Test)

Workpiece material: SCM435

Cutting speed: 250 m/min.

TABLE 2

| | Inside structure[1)] | | | | | | | | |
|---|---|---|---|---|---|---|---|---|---|
| | | | | | | | | W ratio (% by atom) | |
| Sample No. | $d_i$ | $a_i$ | $b_i$ | $b_i/a_i$ | $A_i$ | $B_i$ | $B_i/A_i$ | Second hard phase | Binder phase |
| 1 | 0.68 | 0.41 | 1.78 | 4.34 | 18 | 82 | 4.56 | 8 | 11 |
| 2 | 0.52 | 0.35 | 1.33 | 3.80 | 25 | 75 | 3.00 | 7 | 12 |
| 3 | 0.45 | 0.29 | 1.60 | 5.52 | 19 | 81 | 4.26 | 9 | 13 |
| 4 | 0.71 | 0.45 | 1.80 | 4.00 | 21 | 79 | 3.76 | 10 | 16 |
| 5 | 0.48 | 0.31 | 1.49 | 4.81 | 20 | 80 | 4.00 | 9 | 13 |
| 6 | 0.70 | 0.42 | 1.65 | 3.93 | 18 | 82 | 4.56 | 8 | 12 |
| 7 | 0.83 | 0.57 | 1.81 | 3.18 | 27 | 73 | 2.70 | 8 | 13 |
| *8 | 0.45 | 0.31 | 1.48 | 4.77 | 25 | 75 | 3.00 | 12 | 8 |
| *9 | 0.37 | 0.27 | 1.35 | 5.00 | 28 | 72 | 2.57 | 10 | 6 |

The samples marked "*" are out of the scope of the present invention.

[1)]In the inside structure, di: Mean grain size of the whole hard phase ai: Mean grain size of the first hard phase bi: Mean grain size of the second hard phase Ai: Area ratio of the first hard phase Bi: Area ratio of the second hard phase

TABLE 3

| | Surface structure[2)] | | | | | | Wear resistance[3)] | Chipping resistance[4)] |
|---|---|---|---|---|---|---|---|---|
| sample No. | $b_s$ | $b_s/b_i$ | $A_s$ | $B_s$ | $B_s/A_s$ | Thickness (μm) | (Cutting time) (min) | (Number of impacts) (times) |
| 1 | 1.48 | 0.83 | 22 | 78 | 3.5 | 30 | 64 | 36900 |
| 2 | 2.92 | 2.20 | 15 | 85 | 5.7 | 150 | 60 | 42500 |
| 3 | 1.86 | 1.16 | 10 | 90 | 9.0 | 50 | 65 | 41000 |
| 4 | 2.51 | 1.39 | 15 | 85 | 5.7 | 100 | 56 | 43200 |
| 5 | 1.92 | 1.29 | 12 | 88 | 7.3 | 70 | 62 | 45100 |
| 6 | | | | Absence | | | 68 | 38600 |
| 7 | 3.51 | 1.94 | 8.5 | 91.5 | 10.8 | 260 | 68 | 42300 |
| *8 | 1.79 | 1.21 | 16 | 84 | 5.3 | 160 | 41 | 28200 |
| *9 | | | | Absence | | | 35 | 29000 |

The samples marked "*" are out of the scope of the present invention.

[2)]In the surface region, bs: Mean grain size of the second hard phase

As: Area ratio of the first hard phase

Bs: Area ratio of the second hard phase

[3)]Wear resistance: Cutting time until the amount of wear reaches 0.20 mm (min)

[4)]Chipping resistance: Number of impacts before chipping (times)

Feedrate: 0.20 mm/rev.

Infeed: 1.0 mm

Cutting condition: Wet cutting (Water-soluble cutting fluid)

Evaluation method: Time until the amount of wear reaches 0.2 mm.

(Chipping Resistance Evaluation Test)

Workpiece material: SCM440H

Cutting speed: 150 m/min.

Feedrate: 0.20 mm/rev.

Infeed: 1.5 mm

Cutting condition: Dry cutting

Evaluation method: Number of impacts before chipping

From Tables 1 to 3, it can be seen that sample No. 8 that did not contain Ru experienced premature chipping due to low wear resistance and low thermal impact resistance. Sample No. 9 that contained $Y_2O_3$ instead of Ru also showed low wear resistance and low thermal impact resistance.

In contrast, samples Nos. 1 to 7 made of cermet having the structure within the scope of the present invention all showed excellent wear resistance and good chipping resistance (thermal impact resistance), and therefore exhibited long life as the cutting tool.

Example 2

The cermet having the shape of cutting tool of sample No. 3 made in Example 1 was dressed by using a diamond grinder, and was provided with a coating layer formed thereon by arc ion plating method (sample No. 10). Specifically, the substrate described above was set in an arc ion plating apparatus and heated to 500° C., and a coating layer of $Ti_{0.4}Al_{0.5}Cr_{0.1}N$ was formed thereon. The coating layer was formed in an atmosphere of a mixture of nitrogen gas and argon gas with total pressure of 2.5 Pa, under such conditions as arc current of 100 A, bias voltage of 50 V and heating temperature of 500° C. The coating layer was formed with a thickness of 1.0 μm.

The cutting tool made as described above was subjected to cutting test under cutting conditions similar to those of Example 1. The test showed such a satisfactory cutting performance as the amount of wear reached 0.2 mm in 85 minutes after starting the cutting operation and 49,000 impacts.

Example 3

Cermet of samples Nos. 11 to 19 in Table 4 was made by the method similar to execution example 1.

TABLE 4

| Sample | Material composition (% by mass) | | | | | | | | | | | Sintering condition | |
|---|---|---|---|---|---|---|---|---|---|---|---|---|---|
| | | | | | | | | | | | | Temperature | Time |
| No. | TiCN | WC | TiN | TaC | MoC | NbC | ZrC | VC | Ni | Co | Ru | (° C.) | (hr) |
| 11 | 48 | 15 | 10 | 2 | 0 | 12 | 1 | 1 | 2 | 7 | 2 | 1575 | 1 |
| 12 | 54 | 18 | 5 | 0 | 0 | 10 | 1 | 1 | 2 | 6 | 3 | 1550 | 1 |
| 13 | 43 | 15 | 13 | 0 | 4 | 10 | 1 | 1 | 3 | 5 | 5 | 1575 | 0.5 |
| 14 | 42 | 18 | 10 | 4 | 1 | 8 | 1 | 2 | 1 | 7 | 6 | 1575 | 1 |
| 15 | 60 | 18 | 3 | 1 | 1 | 3 | 1 | 1 | 4 | 5 | 3 | 1525 | 1 |
| 16 | 50.28 | 15 | 10 | 0 | 0 | 9 | 0.2 | 2 | 2.5 | 8 | 3 | 1575 | 1 |
| 17 | 50 | 20 | 10 | 1 | 0 | 1 | 1 | 1 | 2 | 4 | 10 | 1550 | 1.5 |
| *18 | 51 | 10 | 18 | 5 | 0 | 0 | 2 | 2 | 4 | 8 | — | 1550 | 1 |
| *19 | 49 | 5 | 16 | 3 | 1 | 12 | 3 | 0 | 4 | 6 | $Y_2O_3$ 1 | 1550 | 1 |

The samples marked "*" are out of the scope of the present invention.

The cermet obtained as described above was observed under a scanning electron microscope (SEM) and Image analysis by the method similar to method of example 1. The results are shown in Table 5 and Table 6.

Inside structure of the cermet was observed under a transmission electron microscope (TEM), and the compositions of the first hard phase, the second hard phase and the binder phase were analyzed by energy dispersion spectroscopy (EDS). Moreover, Quantitative analysis was also conducted to determine the composition in the core and the surrounding shell of the second hard phase. The composition was calculated by taking the mean value of five grains of the second hard phase arbitrarily selected. The results are shown in Table 5.

The throwaway tips made of the cermet were then subjected to cutting tests (wear resistance evaluation test and chipping resistance evaluation test) under the following cutting conditions. The results are shown in Table 6.

(Wear Resistance Evaluation Test)

Workpiece material: SCM435

Cutting speed: 250 m/min.

Feedrate: 0.25 mm/rev.

Infeed: 1.0 mm

Cutting condition: Wet cutting (Water-soluble cutting fluid)

Evaluation method: Time until the amount of wear reaches 0.2 mm (Chipping Resistance Evaluation Test)

Workpiece material: S45C

Cutting speed: 150 m/min.

Feedrate: 0.20 mm/rev.

Infeed: 1.5 mm

Cutting condition: Wet cutting (Water-soluble cutting fluid)

Evaluation method: Number of impacts experienced before chipping

TABLE 5

| Sample No. | Inside structure[1)] | | | | | | | | | | |
|---|---|---|---|---|---|---|---|---|---|---|---|
| | | | | | | | | Second hard phase | | Binder phase | |
| | $d_i$ | $a_i$ | $b_i$ | $b_i/a_i$ | $A_i$ | $B_i$ | $B_i/A_i$ | Nb ratio (% by atom) | W ratio (% by atom) | Nb ratio (% by atom) | W ratio (% by atom) |
| 11 | 0.54 | 0.42 | 1.45 | 3.45 | 38 | 62 | 1.63 | 2.83 | 2.11 | 0.41 | 6.22 |
| 12 | 0.39 | 0.33 | 1.58 | 4.79 | 48 | 52 | 1.08 | 5.91 | 3.27 | 0.46 | 7.54 |
| 13 | 0.35 | 0.29 | 1.38 | 4.76 | 42 | 58 | 1.38 | 2.18 | 1.86 | 0.63 | 3.96 |
| 14 | 0.57 | 0.48 | 1.32 | 2.75 | 52 | 48 | 0.92 | 1.84 | 1.63 | 0.55 | 3.85 |
| 15 | 0.44 | 0.38 | 1.43 | 3.76 | 53 | 47 | 0.89 | 1.36 | 1.06 | 0.61 | 2.87 |
| 16 | 0.23 | 0.21 | 1.63 | 7.76 | 59 | 41 | 0.69 | 1.73 | 1.34 | 0.52 | 3.67 |
| 17 | 0.16 | 0.15 | 1.51 | 10.07 | 61 | 39 | 0.64 | 1.47 | 1.32 | 0.26 | 3.84 |
| *18 | 0.37 | 0.31 | 1.48 | 4.77 | 43 | 57 | 1.33 | 3.18 | 3.39 | 0.01 | 1.01 |
| *19 | 0.31 | 0.27 | 1.35 | 5.00 | 51 | 49 | 0.96 | 2.81 | 3.94 | 0.06 | 1.75 |

The samples marked "*" are out of the scope of the present invention.

[1)]In the inside structure, di: Mean grain size of the whole hard phase ai: Mean grain size of the first hard phase bi: Mean grain size of the second hard phase Ai: Area ratio of the first hard phase on the whole hard phase Bi: Area ratio of the second hard phase on the whole hard phase

TABLE 6

| Sample No. | Surface structure[2)] $b_s$ | $b_s/b_i$ | $A_s$ | $B_s$ | $B_s/A_s$ | Thickness (μm) | Wear resistance[3)] (Cutting time) (min) | Chipping resistance[4)] (Number of impacts) (times) |
|---|---|---|---|---|---|---|---|---|
| 11 | 1.24 | 0.86 | 31 | 69 | 2.2 | 35 | 63 | 36800 |
| 12 | 2.10 | 1.33 | 43 | 57 | 1.3 | 120 | 61 | 42600 |
| 13 | 1.86 | 1.35 | 10 | 90 | 9.0 | 40 | 64 | 40000 |
| 14 | 1.58 | 1.20 | 55 | 45 | 0.8 | 90 | 69 | 46900 |
| 15 | | | | Absence | | | 63 | 44900 |
| 16 | | | | Absence | | | 55 | 44200 |
| 17 | 3.51 | 2.32 | 8.5 | 91.5 | 10.8 | 230 | 67 | 42100 |
| *18 | 1.79 | 1.21 | 16 | 84 | 5.3 | 150 | 42 | 28100 |
| *19 | | | | Absence | | | 33 | 28400 |

The samples marked "*" are out of the scope of the present invention.
[2)]In the surface region,
bs: Mean grain size of the second hard phase
As: Area ratio of the first hard phase
Bs: Area ratio of the second hard phase
[3)]Wear resistance: Cutting time until the amount of wear reaches 0.20 mm (min)
[4)]Chipping resistance: Number of impacts before chipping (times)

From Tables 4 to 6, it can be seen that sample No. 18 in which Ru was not contained and the amount of W that formed solid solution in the binder phase was less than the amount of W that formed solid solution in the second hard phase experienced premature chipping due to low wear resistance and low thermal impact resistance. Sample No. 19 that contained $Y_2O_3$ instead of Ru also showed low wear resistance and low thermal impact resistance because the amount of W that formed solid solution in the binder phase was less than the amount of W that formed solid solution in the second hard phase.

In contrast, samples Nos. 11 to 17 made of cermet having the structure within the scope of the present invention, all showed excellent wear resistance and good chipping resistance (thermal impact resistance), and therefore exhibited long life as the cutting tool.

Example 4

The cermet having the shape of cutting tool of sample No. 13 made in Example 3 was coated by coating layer of similar to the coating layer of example 2.

The cutting tool made as described above was subjected to cutting test under cutting conditions similar to those of Example 3. The test showed such a satisfactory cutting performance as the amount of wear reached 0.2 mm in 80 minutes after starting the cutting operation and 48,600 impacts.

Example 5

Throwaway tips were prepared in a similar method to example 2 except that the coating layer of the throwaway tip prepared in example 2 was substituted for coating layers shown in Table 7. (Samples Nos. 21 to 38) The throwaway tips thus obtained were subjected to cutting tests (wear resistance evaluation test and chipping resistance evaluation test) under the blow conditions. The results are also shown in Table 7.

(Wear Resistance Evaluation Test)

Workpiece material: SCM435

Cutting speed: 300 m/min.

Feedrate: 0.25 mm/rev.

Infeed: 1.0 mm

Cutting condition: Dry cutting

Evaluation method: Time until the amount of wear reaches 0.2 mm (Chipping Resistance Evaluation Test)

Workpiece material: SCM440H

Cutting speed: 150 m/min.

Feedrate: 0.20 mm/rev.

Infeed: 1.0 mm

Cutting condition: Wet cutting (Water-soluble cutting fluid)

Evaluation method: Number of impacts experienced before chipping

TABLE 7

| Sample No. | PVD Layer Composition | Thickness (μm) | Wear Resistance[3)] (Cutting Time) (Min.) | Chipping Resistance[4)] (Number of Impacts) (times) |
|---|---|---|---|---|
| 21 | $(Ti_{0.43}Al_{0.45}W_{0.07}Si_{0.04}Mo_{0.01})N$ | 1.5 | 66 | 39700 |
| 22 | $(Ti_{0.44}Al_{0.47}W_{0.03}Si_{0.03}Y_{0.03})N$ | 1.8 | 62 | 41300 |
| 23 | $(Ti_{0.43}Al_{0.48}W_{0.10}Si_{0.01}Hf_{0.01})N$ | 0.5 | 68 | 44300 |
| 24 | $(Ti_{0.35}Al_{0.45}W_{0.05}Si_{0.05}Nb_{0.10})C_{0.5}N_{0.5}$ | 0.9 | 59 | 42100 |
| 25 | $(Ti_{0.45}Al_{0.46}W_{0.04}Si_{0.02}Nb_{0.03})N$ | 1.2 | 59 | 45400 |
| 26 | $(Ti_{0.41}Al_{0.50}W_{0.05}Si_{0.03}Nb_{0.01})N$ | 2.1 | 64 | 38600 |
| *27 | $(Ti_{0.45}Al_{0.46}W_{0.04}Si_{0.02}Nb_{0.03})N$ | 1.2 | 41 | 29500 |
| *28 | TiCN | 3.2 | 32 | 37500 |
| *29 | $(Ti_{0.5}Al_{0.5})N$ | 1.8 | 41 | 28200 |
| *30 | $(Ti_{0.7}Al_{0.3})N$ | 2.0 | 45 | 32400 |
| *31 | $(Ti_{0.4}Al_{0.45}Si_{0.05}Nb_{0.1})N$ | 0.7 | 43 | 34200 |
| *32 | $(Ti_{0.38}Al_{0.5}Si_{0.12})N$ | 0.8 | 39 | 35400 |

TABLE 7-continued

| Sample No. | PVD Layer Composition | PVD Thickness (μm) | Wear Resistance[3] (Cutting Time) (Min.) | Chipping Resistance[4] (Number of Impacts) (times) |
|---|---|---|---|---|
| *33 | $Ti_{0.36}Al_{0.60}W_{0.02}Si_{0.01}Mo_{0.01}N$ | 1.3 | 38 | 35600 |
| *34 | $Ti_{0.2}Al_{0.53}W_{0.2}Si_{0.02}Ta_{0.05}N$ | 1.5 | 37 | 34900 |
| *35 | $Ti_{0.40}Al_{0.45}W_{0.05}Si_{0.1}N$ | 2.2 | 36 | 35100 |
| *36 | $Ti_{0.26}Al_{0.50}W_{0.02}Si_{0.02}Mo_{0.2}N$ | 4.2 | 39 | 35800 |
| *37 | $Ti_{0.40}Al_{0.45}W_{0.05}Si_{0.1}Nb_{0.1}N$ | 2.7 | 35 | 34400 |
| *38 | $Ti_{0.56}Al_{0.40}W_{0.02}Si_{0.01}Mo_{0.01}N$ | 1.5 | 38 | 31100 |

The samples marked "*" are out of the scope of the present invention.

[3]Wear resistance: Cutting time until the amount of wear reaches 0.20 mm (min)

[4]Chipping resistance: Number of impacts before chipping (times)

From Table 7, Samples Nos. 21 to 26, which are covered by coating layer comprised of $Ti_{1-a-b-c-d}Al_aW_bSi_cM_d(C_xN_{1-x})$ mentioned above show higher wear resistance and higher chipping resistance than Samples Nos. 27 to 38 wherein a composition of a coating layer is out of the above range.

The invention claimed is:

1. A Ti containing cermet comprising:

Co and Ni, at least one of a carbide, a nitride and a carbonitride of at least one selected from the metal elements of groups 4, 5 and 6 of the periodic table, of which a main component is Ti, and Ru in a concentration of from 0.1% to 10.0% by mass of cermet.

2. The Ti containing cermet according to claim 1, wherein the surface is covered by a coating layer comprising $Ti_{1-a-b-c-d}Al_aW_bSi_cM_d(C_xN_{1-x})$, wherein M is at least one selected from the group consisting of Nb, Mo, Ta, Hf and Y; and wherein $0.45 \leqq a \leqq 0.55$; $0.01 \leqq b \leqq 0.1$; $0.01 \leqq c \leqq 0.05$; $0.01 \leqq d \leqq 0.1$; $0 \leqq x \leqq 1$.

3. A Ti containing cermet comprising:

a first hard phase comprising at least one of TiC, TiN and TiCN;

a second hard phase comprising at least one of a carbide, a nitride and a carbonitride of at least one selected from the metal elements of groups 4, 5 and 6 of the periodic table; and a binder phase comprising Ru, Co and Ni, wherein the first and second hard phases are bound together by the binder phase, wherein Ti is a main component of the cermet; and wherein a concentration of the Ru is from 0.1% to 10.0% by mass of cermet.

4. The Ti containing cermet according to claim 3, wherein the second hard phase and the binder phase contain W, and wherein an amount of W in the binder phase is larger than an amount of W in the second hard phase.

5. The Ti containing, cermet according to claim 4, wherein the second hard phase further comprises Nb, and an amount of Nb in the second hard phase is larger than an amount of Nb in the binder phase.

6. The Ti containing cermet according to claim 4, wherein a proportion of W content to the total amount of the metal elements of groups 4, 5 and 6 of the periodic table in the second hard phase is in a range from 10 to 20% by mass, and that in the binder phase 3 is in a range from 30 to 70% by mass.

7. The Ti-based cermet according to claim 3, wherein the surface is covered by a coating layer comprising $Ti_{1-a-b-c-d}Al_aW_bSi_cM_d(C_xN_{1-x})$, wherein M is at least one selected from the group consisting of Nb, Mo, Ta, Hf and Y; and wherein $0.45 \leqq a \leqq 0.55$; $0.01 \leqq b \leqq 0.1$; $0.01 \leqq c \leqq 0.05$; $0.01 \leqq d \leqq 0.1$; $0 \leqq x \leqq 1$.

* * * * *